US005510952A

United States Patent [19]

Bonavia et al.

[11] Patent Number: 5,510,952

[45] Date of Patent: Apr. 23, 1996

[54] IGNITION SYSTEM USING MULTIPLE GATED SWITCHES WITH VARIABLE DISCHARGE ENERGY LEVELS AND RATES

[75] Inventors: Howard V. Bonavia, Groton; John E. Killean, Norwich, both of N.Y.

[73] Assignee: Simmonds Precision Engine Systems Inc., Akron, Ohio

[21] Appl. No.: 396,883

[22] Filed: Mar. 1, 1995

Related U.S. Application Data

[63] Continuation of Ser. No. 92,160, Jul. 15, 1993.

[51] Int. Cl.[6] ..... F02P 3/06

[52] U.S. Cl. ..... 361/251; 307/9.1; 307/10.1; 123/596; 123/618; 315/209 CD

[58] Field of Search ..... 361/247, 248, 361/249, 251, 253, 256, 257, 263, 166, 167; 123/598, 599, 620, 605, 618, 650; 307/9.1, 10.1, 10.6, 141; 315/209 CD, 209 T, 209 SC

[56] References Cited

U.S. PATENT DOCUMENTS

| | | | |
|---|---|---|---|
| 3,605,714 | 9/1971 | Hardin et al. | 123/598 |
| 3,874,349 | 4/1975 | Fitzner | 123/117 R |
| 3,880,132 | 4/1975 | Whatley Jr. | 123/599 |
| 3,921,606 | 12/1975 | Habert | 123/599 |
| 4,228,778 | 10/1980 | Rabus et al. | 123/605 |
| 4,359,037 | 11/1982 | Stangl | 123/643 |
| 4,366,801 | 1/1983 | Endo et al. | 123/620 |
| 4,369,758 | 1/1983 | Endo | 123/620 |
| 4,509,488 | 4/1985 | Forster et al. | 123/481 |
| 4,690,124 | 9/1987 | Higashiyama | 123/643 |
| 4,825,844 | 5/1989 | Fasola | 123/605 |
| 5,053,913 | 10/1991 | Lozito | 361/257 |
| 5,148,084 | 9/1992 | Frus | 315/76 |

FOREIGN PATENT DOCUMENTS

| | | |
|---|---|---|
| 0026429 | 4/1981 | European Pat. Off. . |
| 0369236 | 5/1990 | European Pat. Off. . |
| 1157871 | 6/1958 | France . |
| 3129078A1 | 2/1983 | Germany . |

*Primary Examiner*—William M. Shoop, Jr.
*Assistant Examiner*—Peter Ganjoo
*Attorney, Agent, or Firm*—Leonard L. Lewis; William E. Zitelli

[57] ABSTRACT

An ignition system for a gas turbine engine includes a plurality of igniters, an energy storage capacitance, a charging circuit for charging the capacitance, a plurality of gated switches, with at least one switch connected between each igniter and the capacitance, and control means for discharging respective amounts of energy from the capacitance to each respective igniter at respective spark rates.

16 Claims, 3 Drawing Sheets

IGNITION SYSTEM USING MULTIPLE GATED SWITCHES WITH VARIABLE DISCHARGE ENERGY LEVELS AND RATES

This is a continuation of copending application Ser. No. 08/092,160 filed on Jul. 15. 1993.

BACKGROUND OF THE INVENTION

The invention relates generally to ignition systems. More particularly, the invention relates to ignition systems that use gated switches for controlling energy discharge to a plurality of igniters.

Conventional ignition systems typically include one or more igniters through which energy is discharged from an energy storage device such as a capacitor. The discharge is characterized by a high current/voltage spark or plasma that occurs due to high voltage breakdown across the igniter gap, including air gap and semiconductor gap igniter plugs.

A conventional ignition system for an internal combustion engine, such as, for example, a gas turbine aircraft engine, includes a charging circuit, a storage capacitor, a discharge circuit and at least one igniter plug located in the combustion chamber. The discharge circuit includes a switching device connected in series between the capacitor and the plug. For many years, such ignition systems have used spark gaps as the switching device to isolate the storage capacitor from the plug. When the voltage on the capacitor reaches the spark gap break over voltage, the capacitor discharges through the plug and a spark is produced. More recently, solid state switches such as SCR, GTO and MCT devices have been investigated.

It is generally known that energy levels from multiple storage means can be combined to increase discharge energy through a single igniter. It is also known that a single energy storage source can be multiplexed to produce sparks in a plurality of igniters, such as shown in U.S. Pat. No. 3,880,132 issued to Whatley. However, this arrangement is unsuitable for applications such as gas turbine engine ignition systems because the use of a single pulse forming (wave shaping) network can overstress solid state gated switches. In another arrangement, such as shown in U.S. Pat. No. 3,605,704 issued to Hardin, a single capacitor is used to produce sparks in multiple plugs including the use of separate pulse shaping networks to reduce stress on the switches, such as might be used in a spark distribution system that fires each plug at a rate proportional to engine speed. However, this system is unsuitable for aerospace applications wherein discharge energy and spark rates need to be controlled based on factors other than engine speed, such as igniter wear, temperature, fuel mix, and turbulence, for example.

The need exists, therefore, for an ignition or spark discharge system that can produce different energy level discharges to selectable igniters, as well as at different spark rates. Particularly needed is such a system that can be adapted for use with gas turbine engines, such as used in aircraft applications.

SUMMARY OF THE INVENTION

Accordingly, the invention contemplates an ignition system for a gas turbine engine comprising: a plurality of igniters, an energy storage capacitance, a charging circuit for charging the capacitance, a plurality of gated switches, with at least one switch connected between each igniter and the capacitance, and control means for discharging respective amounts of energy from the capacitance to each respective igniter at respective spark rates.

These and other aspects and advantages of the present invention will be readily understood and appreciated by those skilled in the art from the following detailed description of the preferred embodiments with the best mode contemplated for practicing the invention in view of the accompanying drawings.

DETAILED DESCRIPTION OF THE INVENTION

Figure 1:
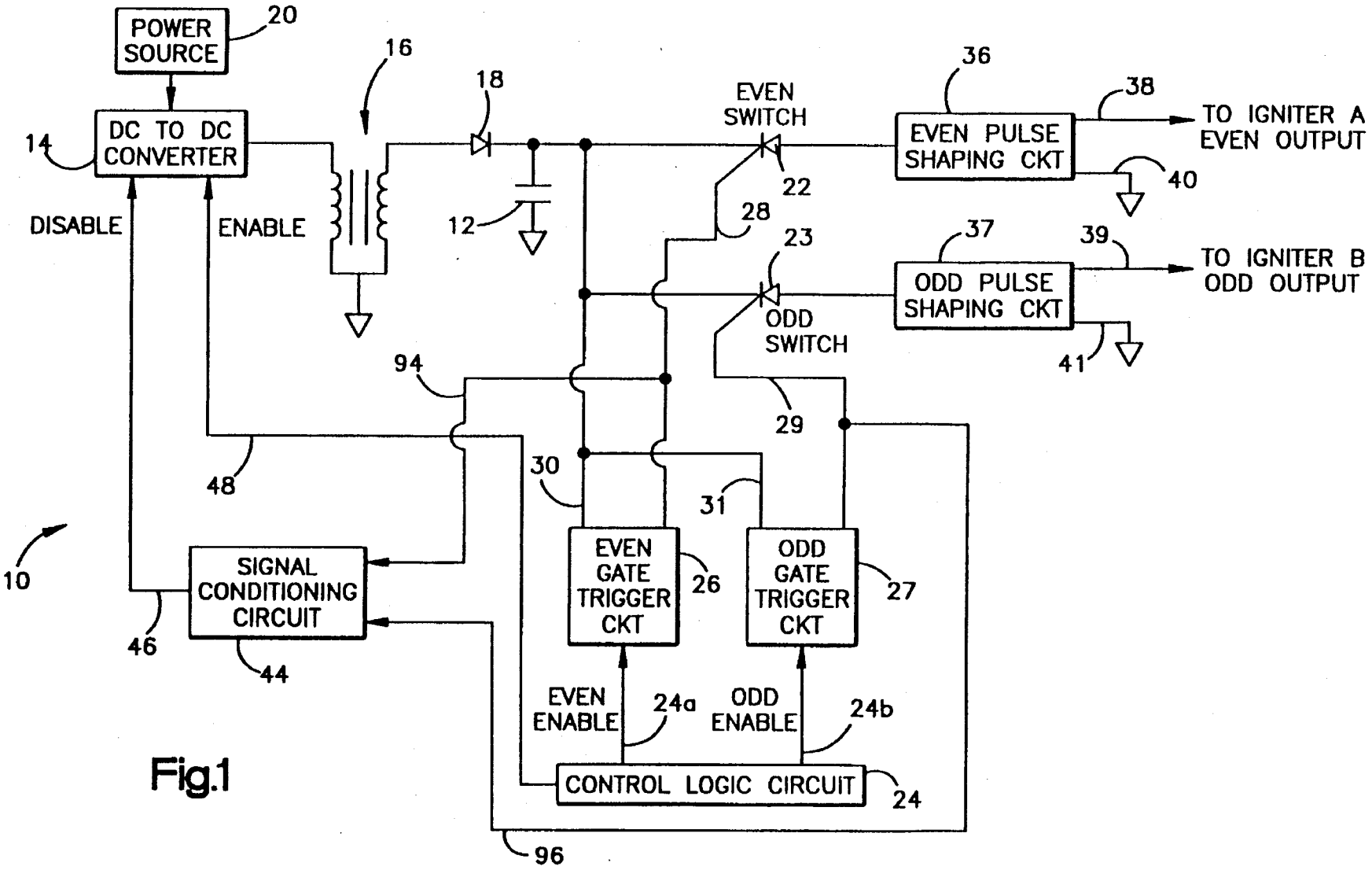
FIG. 1 is an electrical schematic in primarily functional block diagram form of an ignition system and exciter circuit according to the present invention.

With reference to FIG. 1, a schematic functional block diagram of an embodiment of an exciter circuit and ignition system in accordance with the invention is generally designated by the numeral 10. Although an embodiment of the invention is described herein with respect to a specific form or configuration of an exciter circuit in combination with a specific type of ignition system, this description is intended to be exemplary and should not be construed in a limiting sense. Those skilled in the art will readily appreciate that the advantages and benefits of the invention can be realized with many different types of ignition systems and exciter circuit designs including, but not limited to, unidirectional discharge, oscillatory discharge, AC and/or DC charging systems, capacitive and other discharge configurations, spark gap and solid-state switching circuits, high tension and low tension discharge circuits, and so on, to name just a few of the many different ignition systems and exciter circuit configurations. Furthermore, the invention can be used in combination with ignition systems for many different types of engines, although the description herein is with specific reference to use with a gas turbine engine ignition system particularly well-suited for use in aerospace applications.

An exemplary exciter circuit is shown in FIG. 1, and includes a main storage capacitance or capacitor 12 that is connected to a charging circuit 14 which receives input power from a power source 20, such as a DC voltage supply from the engine power plant (in the case of an AC circuit, for example, the source 20 could be an output from the engine alternator.) The charging circuit 14 can be an AC or DC charging source depending on the particular requirements for each application. The charging circuit 14 design can be conventional, such as a DC converter as in the drawings, or a continuous AC supply circuit, for example.

The converter 14 includes a power transformer 16 that produces an AC charging current in its secondary, and the current is half-wave rectified by a diode 18 connected to the capacitor 12. Full wave rectification could also be used if needed for a particular application.

The capacitor 12 is also connected to one side of a pair of switching mechanisms or devices 22,23. The switching devices can be realized many different ways such as in the form of a spark gap, a gated spark gap, gated solid state switches such as SCR, GTO or MCT devices, either single or cascaded, and so on. In the embodiment shown herein, single SCRs are used for each switch. One of the SCRs 22 is designated as the "even" switch 22 and the other SCR is designated as the "odd" switch 23, however, these designations are arbitrary and only used for convenience and ease of explanation. According to an important aspect of the invention, the capacitor 12 can be sequentially discharged through a plurality of igniters using different discharge energies at different spark rates. In this embodiment, we show a two channel design that implements two discharge energy levels and spark rates. Therefore, one channel will be referred to as the even channel and the other the odd channel in order to distinguish the two.

The ignition system exciter circuit further includes a control logic circuit 24 that enables and disables the discharge channels at the appropriate times by providing control signals to respective trigger circuits 26,27 via lines 24*a* and 24*b*. The trigger circuits 26,27 respectively produce gate trigger outputs on lines 28,29 to cause the corresponding SCR to turn on at the appropriate time. The trigger circuits 26,27 also respectively receive as an input (on lines 30,31) the voltage level stored on the capacitor 12. In the particular embodiment herein, an SCR is triggered on as soon as the capacitor 12 is charged to the appropriate level for the respective igniter. Those skilled in the art will readily recognize this as a "wait and charge" timing arrangement, but other timing sequences such as "charge and wait", for example, could easily be used with the invention. For example, the control circuit can trigger the switch closed after the capacitor reaches a predetermined charge level, or the circuit can trigger the switch at a predetermined rate based on the desired spark rate.

Figure 2:
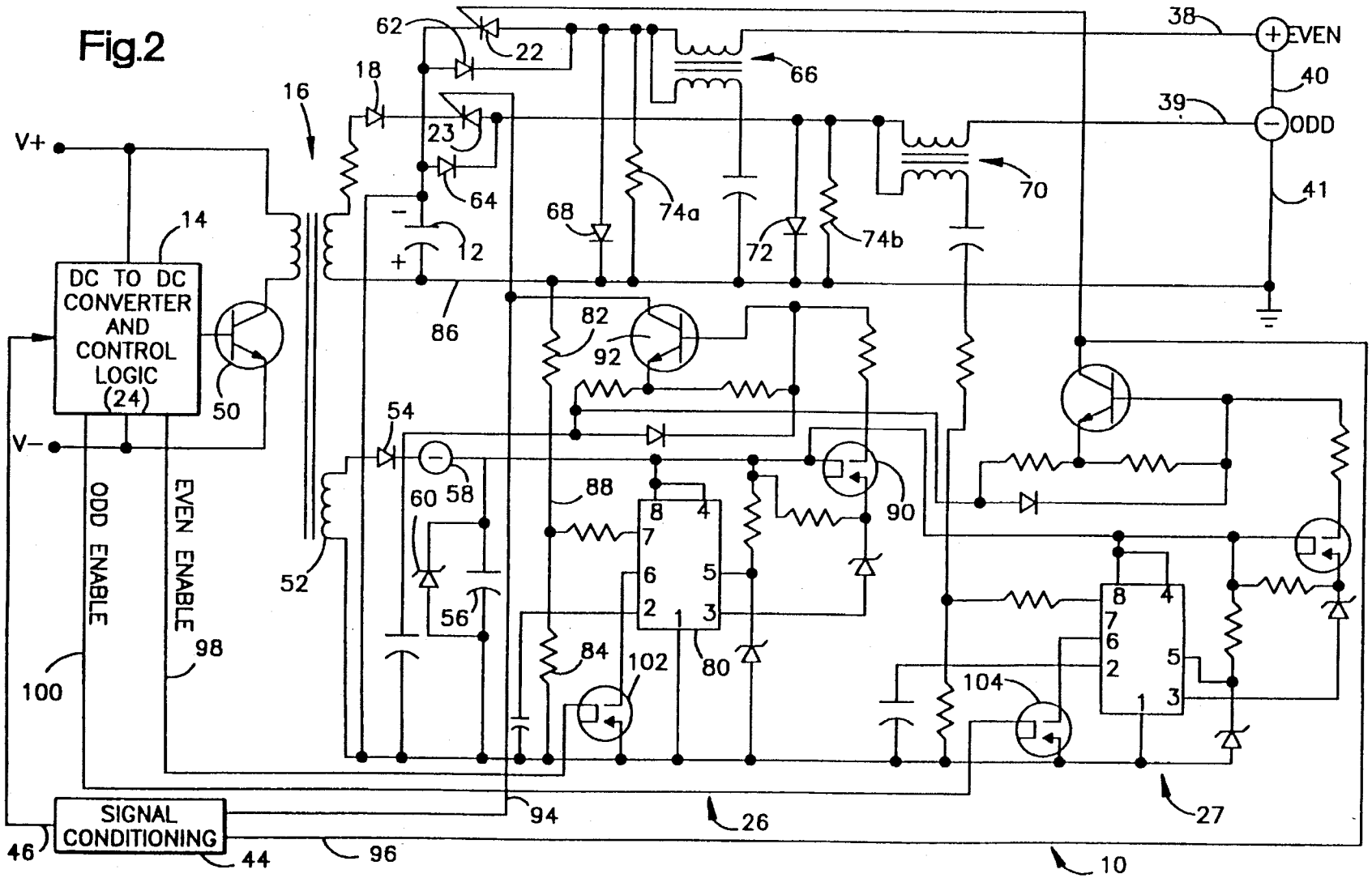
FIG. 2 is a more detailed schematic of one embodiment of the invention as shown in FIG. 1.

Each switching device 22,23 is also connected to a corresponding pulse shaping and output circuit 36,37. The output circuits 36,37 configurations can be selected based on the particular application of the ignition system. In this exemplary circuit, the output circuits include free wheeling diodes which force the discharge current to be unidirectional, such as is typically required for solid state switching mechanisms. The diode can be omitted to produce oscillatory discharge circuits such as are common with spark gap switching devices. An exemplary embodiment of a high tension output circuit is illustrated in FIG. 2 and is well known to those skilled in the art. This is but one example, however, and its description herein should not be construed as a limitation of the invention. Other pulse shaping circuits are well known, such as current and/or voltage step-up circuits and distributed or multiplexed output controls, just to name a few examples.

Each pulse shaping circuit output is connected to an igniter (not shown) by a conductor, such as a high voltage/current cable lead 38,39 and a return lead 40,41. Examples of igniters that can be used include airgap, semiconductor, but this list is not exhaustive and should not be construed in a limiting sense as to the present invention.

A signal conditioning circuit 44 has inputs connected to the gate trigger control signals from the trigger circuits 26,27. The conditioning circuit 44 monitors these signals, and when a trigger signal is detected, the circuit 44 sends a disable control signal on line 46 to the converter 14, thereby turning the converter off during the capacitor 12 discharge period. The converter 14 is turned back on by an enable signal on line 48 produced by the control circuit 24.

In operation, each switching mechanism is triggered on in a controlled sequence after the capacitor is fully charged, and the capacitor voltage is impressed across the corresponding igniter gap for the igniter in sequence. Assuming the voltage exceeds the breakover voltage of the gap, a plasma or similar conductive path jumps the gap and the capacitor quickly discharges with current rising rapidly as represented by the simplified graph 26 in the drawing. Typical discharge times are on the order of tens of microseconds. In accordance with the invention, although the switches 22,23 are sequentially triggered, the control circuit 24 operates with the trigger circuits 26,27 so that each switch can be triggered at a different rate to produce different spark rates for each igniter, if desired. The control circuits also operate to allow different energy levels to be discharged from the same capacitance 12 through the different igniters. Of course, the designer may only want different spark rates but the same discharge energy levels for each igniter, or conversely may want the same spark rate for each igniter but different energy levels. All these different combinations as well as others can be realized with the present invention with simple modifications to the control circuit. For example, different discharge energies can be realized by adjusting threshold levels on a comparator used to sense the charge stored on the capacitor 12. Different spark rates can easily be implemented by simply changing the timing clocks for the control signals used to trigger the switches and control the converter 14. These design alternatives will be apparent to those skilled in the art from the following description of a detailed embodiment (FIG. 2) of the circuit shown in FIG. 1.

With reference then to FIG. 2, we show in greater detail an embodiment of the invention, such as may be used, for example, to realize the circuit shown in FIG. 1 (wherein like components are given like reference numerals.) The charging circuit 14 receives input energy $V^+$ and $V^-$ from a power source. The charging circuit can be a simple DC chopper circuit that includes a switch that is periodically activated to pulse current through the primary of the power transformer 16. The rectifying diode 18 provides unidirectional half-wave charging current to the main storage capacitance 12.

A tertiary winding 52 produces an ac voltage that is rectified by a diode 54 to charge a capacitor 56. The DC voltage that appears across the capacitor is used as a DC supply for the various control devices in the circuit 10. A current regulator 58 and zener diode 60 can be used to provide a stable DC supply.

The capacitor 12 is connected to the switching devices 22,23. Shunting diodes 62,64 are connected across the anode and cathode of each SCR to reduce the risk of damage to the solid state switches from reverse currents. The even channel switch 22 is connected to a high voltage output pulse shaping circuit 36 that includes a step-up transformer 66 and a free wheeling diode 68. The odd channel switch 23 is similarly connected to a step-up transformer 70 and free wheeling diode 72. The step-up transformers allow a higher initial voltage to appear across the plug gaps than can be stored on the capacitor 12 when a single device SCR is used. This is because of the device limitations as to reverse blocking voltage and breakdown. Of course, cascaded switches can be used to increase the voltage stored on the capacitor 12. Also, the different discharge channels can use different pulse shaping circuits, and in fact one could be unidirectional (by use of the free wheeling diode) while the other could be oscillatory (for example with the use of a spark gap.) It should further be noted that the invention is not limited to only a two discharge channel design, but can be implemented in a larger plurality of channels with simple appropriate changes to the control and trigger logic circuits as will be apparent to those skilled in the art.

Discharge resistors 74*a* and 74*b* provide a discharge path in the event that an igniter does not break over to produce a spark. The transformers 66,70, are connected, of course, to their respective igniters (not shown) via the high tension leads 38,39 and returns 40,41.

Each SCR 22,23 has a gate terminal that is connected to a trigger circuit 26,27. The circuits 26,27 are identical in design (though they control different operating discharge rates and energy levels for each channel), therefore, the circuitry will be described for one channel only.

The trigger circuit 26 includes a comparator device 80, such as part no. ICM 7555 available from Harris Semiconductors. An input pin 7 of the comparator is connected to a resistor divider that includes series resistors 82 and 84. The resistor divider is connected as at node 86 to the capacitor 12. Therefore, the comparator can monitor the charge level on the capacitor. The comparator device 80 has an adjustable internal threshold which can be selected, along with the resistor divider components, to trigger the comparator at any desired charge level on the capacitor. Also, the sense node 88 could be connected to an external circuit, such as an on board controller on an aircraft, to dynamically change the discharge energy level by adjusting the resistor divider sensitivity level (or the user could simply connect an external bias circuit to the sense node 88 to customize the channel discharge energy level as desired.)

When the capacitor is charged to the threshold level set by the designer, the comparator device 80 produces a short pulse at output pin 5 that turns on a switching FET transistor 90 which in turn pulses a PNP transistor 92. The PNP transistor thus applies a gate drive pulse signal to the SCR 22 that causes the SCR to conduct, essentially short circuiting the capacitor 12 across its associated igniter via the step-up transformer 66. After the capacitor 12 discharges below the sustaining voltage of the SCR 22, the SCR 22 returns to its blocking state and the capacitor 12 can be charged for the next cycle. The foregoing description of the circuit 26 is sufficient for purposes of understanding and practicing the invention herein; however, if interested, a more detailed description of the circuit is set forth in pending U.S. patent application Ser. No. 08/040,720 filed on Apr. 1, 1993, entitled "EXCITER CIRCUIT USING GATED SWITCHES", which application is commonly owned by the assignee of the present invention, the entire disclosure of which is fully incorporated herein by reference.

The signal conditioning circuit 44 detects the gate trigger pulse from the PNP transistor 92 via line 94 (and also monitors the occurrence of a trigger signal in the odd channel via line 96). The conditioning circuit 44 can be a simple OR circuit and pulse generator such as a one-shot that appropriately isolates the trigger circuitry from the converter 14. The conditioning circuit produces a converter disable signal on line 46. This disable signal temporarily stops operation of the converter (thereby preventing charging current to the capacitor while the SCRs are in conduction) until the capacitor has discharged and an enable signal is received from the control logic 24 (note that in FIG. 2 the control logic is shown as a single functional block with the converter although this arrangement is optional to the designer) to restart the converter. The disable signal is processed by the converter 14 in accordance with the converter design. As an example, the disable signal can be used to interrupt the base drive to the chopper transistor 50.

The control logic circuit 24 produces a control signal on line 98 that enables the even channel. The odd channel enable signal is provided on line 100. The channel enable signal for the even channel controls operation of an enable FET switch 102. When the FET switch 102 is turned on, the comparator device 80 is disabled and therefore cannot trigger the even channel switching device 22 into conduction. Similarly, an odd channel FET switch 104 is used to enable and disable the odd channel comparator.

Figure 3A:
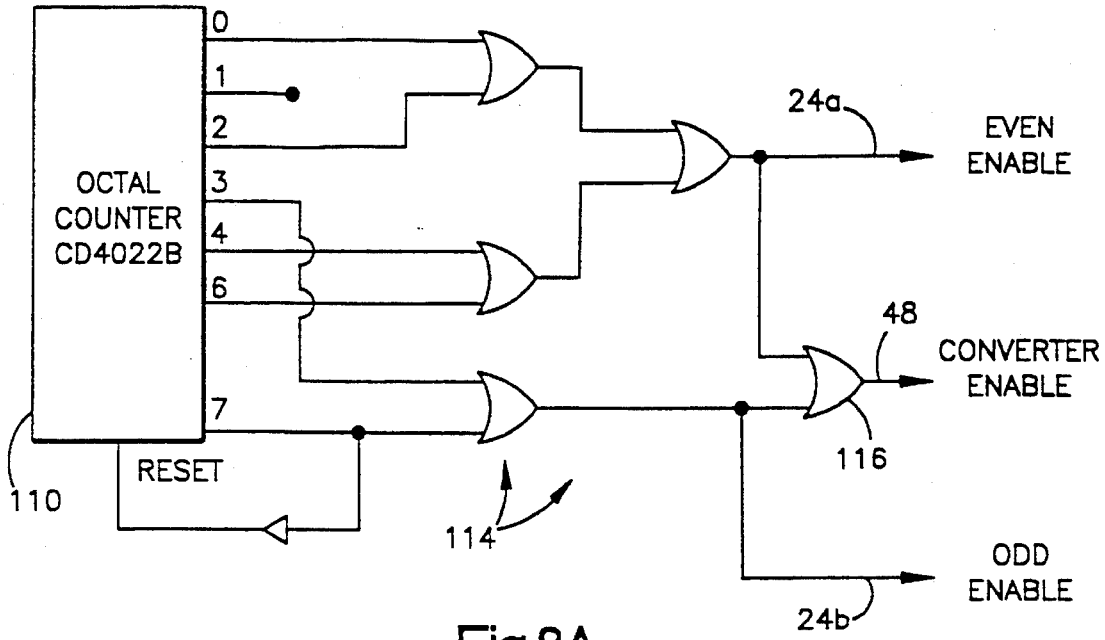
FIG. 3 is a more detailed schematic of a control circuit that can be used in the embodiments of FIGS. 1 and 2, and a simplified timing diagram showing operation of the control circuit.
Figure 3B:
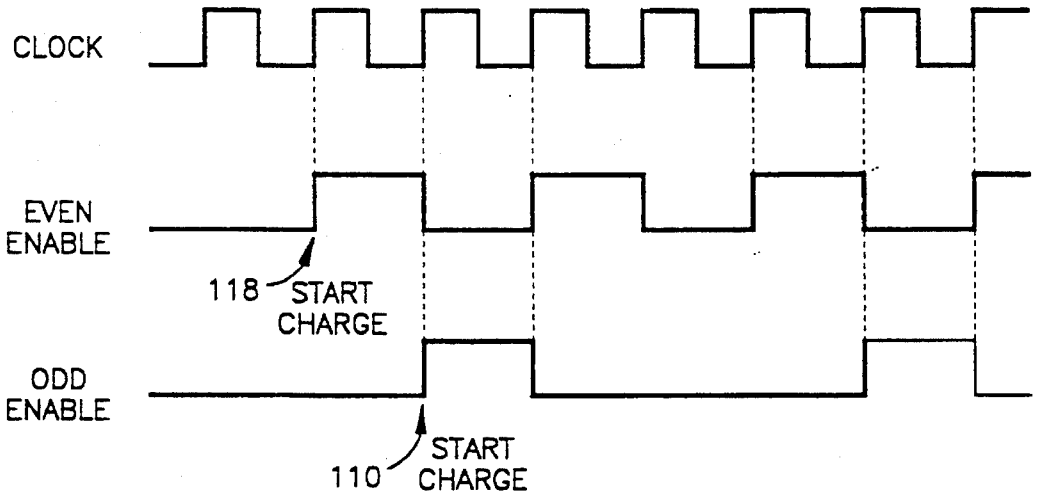

With reference next to FIG. 3, we show an embodiment of a control logic circuit suitable for use with the invention, as well as a representative timing diagram for a two channel design. The control logic is realized in the form of a counter 110 that receives a clock drive 112 from a suitable clock source (not shown). A series of logic gates such as 0R gates 114 are used to decode the counter outputs to produce the desired even and odd channel enable timing signals. In this case, the even signal has a pulse rate that is twice the frequency as the od channel. Other timing scenarios can be used of course and implemented in many different ways. Further note that an additional OR gate 116 is used to produce a converter 14 enable signal. In the example embodiment herein, the rising edge of either the even or odd enable signal, such as at 118, causes the converter to charge the capacitor 12, provided that there is not a disable signal appearing on the control line 46 (which would indicate that the capacitor 12 is still discharging through a conducting SCR.) The signal conditioning circuit produces a disable signal pulse that lasts for a time period that is sufficient to allow the capacitor 12 to discharge and the SCR device to recover and fully turn off. Therefore, this disable pulse can be rather short in duration. Other sensing circuits could be added to affirmatively detect when the SCR device turn off, if desired.

Operation of the described embodiment of the invention is as follows. Assuming that the capacitor 12 is discharged and the switches 22,23 are off (non-conducting), the converter 14 is enabled by the control circuit 24 when either or both of the even/odd channel enable signals is high. The capacitor 12 quickly charges, typically on the order of tens of milliseconds. Whichever channel is enabled (even or odd) for the current discharge cycle, the corresponding comparator monitors the capacitor charge level. When the capacitor is charged to the preselected discharge energy level, the comparator pulses the corresponding switch into conduction and the capacitor discharges through the associated igniter. During this discharge period the signal conditioning circuit disables the converter 14. The capacitor 12 discharge time is very short and as soon as the switching device 22,23 turns off, the capacitor can be charged. The charging cycle, however, does not begin until the next enable signal from the control logic is received, which signal also functions to select which channel will be the discharge channel for the next cycle.

Thus, an ignition system and exciter circuit are provided that can be used to produce individual spark rates for a plurality of igniters, as well as to permit discharge of individual energy levels through the igniters from a single energy storage device. This significantly increases the flexibility and utility of the ignition system and exciter circuit for many different applications, particularly in the aerospace industry.

While the invention has been shown and described with respect to specific embodiments thereof, this is for the purpose of illustration rather than limitation, and other variations and modifications of the specific embodiments herein shown and described will be apparent to those skilled in the art within the intended spirit and scope of the invention as set forth in the appended claims.

We claim:

1. An ignition system for a gas turbine engine comprising: a plurality of igniters, an energy storage capacitance, a charging circuit for charging the capacitance, a plurality of gated switches, with at least one switch connected between each igniter and the capacitance for controlling the igniter spark rate, and control means for discharging energy from the capacitance to each respective igniter at an individually selectable spark rates for each igniter.

2. The ignition system according to claim 1 wherein said control means comprises spark rate timing means that determines a spark rate interval for each igniter.

3. The ignition system according to claim 2 wherein said spark rate timing means comprises means for sensing when the capacitance is charged to a predetermined level.

4. The ignition system according to claim 3 wherein said timing means selectively triggers one of the switches after the capacitance is charged to a predetermined level and inhibits charging of the capacitance for a predetermined time interval after the trigger event.

5. The ignition system according to claim 3 wherein said control means controls the discharge energy through each igniter by triggering the corresponding switch when the capacitance is charged to a selectable voltage level.

6. A spark discharge system for a gas turbine engine comprising: a plurality of igniters, an energy storage capacitance, a charging circuit for charging the capacitance, a plurality of gated switches, with at least one switch connected between each igniter and the capacitance for controlling discharge of energy from the capacitance to the igniter, and control means for controlling individually selectable amounts of energy to be discharged from the capacitance to each respective igniter by said switches.

7. The system of claim 6 wherein said switches comprise MCT devices.

8. The system of claim 6 wherein said switches comprise SCR or GTO devices.

9. The system of claim 6 wherein said switches comprise gated gas discharge tubes.

10. An exciter circuit for an ignition system comprising: an energy storage capacitance; a plurality of igniters that discharge energy from the capacitance in sequence; a plurality of switch means, each respectively connected between said capacitance and a respective igniter; and means for charging said capacitance to an individually selectable level dependent on which igniter is next to discharge in the sequence and triggering said switch means according to the sequence.

11. The exciter circuit of claim 10 wherein said charging means comprises means for triggering said respective switch means at different rates to permit different spark rates for said igniters.

12. The exciter circuit of claim 11 wherein each switch means and respective igniter comprise a discharge path for said capacitance, said charging means comprising means for determining when said capacitance is charged for each of said discharge paths.

13. The exciter circuit of claim 12 wherein said determining means comprises a comparator associated with each discharge path, each comparator having a selectable threshold level to control discharge energy through the respective discharge path.

14. The exciter circuit of claim 13 wherein each comparator is enabled during periods when the corresponding discharge path is next in sequence to discharge the capacitance.

15. The exciter circuit of claim 14 wherein said charging and triggering means operate to produce a hold and charge spark cycle.

16. The exciter circuit of claim 15 wherein said comparator thresholds can be selected by an externally connected circuit.

* * * * *